United States Patent [19]

Woodman

[11] 4,431,054

[45] * Feb. 14, 1984

[54] SEAL ASSEMBLY RELEASING TOOL

[75] Inventor: Daniel C. Woodman, Hermosa Beach, Calif.

[73] Assignee: Hughes Tool Company, Houston, Tex.

[ * ] Notice: The portion of the term of this patent subsequent to Jun. 8, 1999 has been disclaimed.

[21] Appl. No.: 371,145

[22] Filed: Apr. 23, 1982

Related U.S. Application Data

[63] Continuation of Ser. No. 193,314, Oct. 2, 1980, Pat. No. 4,333,528.

[51] Int. Cl.[3] ..... E21B 23/00

[52] U.S. Cl. ..... 166/125; 166/117.7

[58] Field of Search ..... 166/125, 117.7, 206; 81/57.18; 294/86.25, 86.3, 94

[56] References Cited

U.S. PATENT DOCUMENTS

| | | | |
|---|---|---|---|
| 1,389,710 | 6/1921 | Thomas et al. | 166/117.7 |
| 1,627,842 | 5/1927 | Edwards | 166/117.7 |
| 1,737,305 | 11/1929 | Fleming | 166/117.7 |
| 2,462,478 | 2/1949 | Edwards | 166/117.7 |
| 2,665,888 | 1/1954 | Claypool et al. | 166/117.7 |
| 3,273,646 | 9/1966 | Walker | 166/86 |
| 3,322,006 | 5/1967 | Brown | 166/117.7 X |
| 3,434,543 | 3/1969 | Webb | 166/117.7 X |
| 4,333,528 | 6/1982 | Woodman | 166/117.7 |

*Primary Examiner*—Ernest R. Purser
*Assistant Examiner*—Thuy M. Bui
*Attorney, Agent, or Firm*—Robert A. Felsman; Guy Porter Smith

[57] ABSTRACT

A seal assembly releasing tool is shown having an outer support case and an inner unlocking element rotatably mounted on a shaft and coupled by a planetary gear train. The seal assembly is provided with cam surfaces into which cam followers latch for securely connecting the tool to the seal assembly and enabling the outer case to turn the assembly in one direction while the inner element turns the locking sleeve of the seal assembly in the other direction to release the seal assembly.

6 Claims, 5 Drawing Figures

26
14
12
10
42
44
46
96
40
50
52
54
56
60
58
39
48
28
90
94
30
68
32
64
66
38
64
92
62
34
62
70
74
79
72
76
77
78
84
80
78
82
16
79
86
87
18
24

98
100
108
106
132
154
142
130
102
141
104
144
138
145
136
110
144
134
146
140
120
148
48
152
150
50
160
48
112
114
116
114
156
118
152
158
122
121
124
128
124
156
129
94
126

SEAL ASSEMBLY RELEASING TOOL

RELATED APPLICATION

This application is a continuing application of my co-pending application Ser. No. 193,314 filed Oct. 2, 1980 entitled SEAL ASSEMBLY RELEASING TOOL U.S. Pat. No. 4,333,528, issued June 8, 1982.

BACKGROUND OF THE INVENTION

The present invention relates to a seal assembly releasing tool and, more particularly, to a releasing tool which may be landed on a casing hanger seal assembly of a well, such as an oil well, and rotated in one direction to lock with the casing hanger seal assembly thus permitting the tool to rotate in the opposite direction for releasing the seal assembly from the outer well head casing.

In conventional wells including oil wells used for subsea drilling, it is common to use an outer well head casing through which is run an inner well head casing. As the subsea wells often extend some 6,000 feet to the sea floor, it is necessary to assemble the riser runs in sections. In order to do this, it is clear that means must be provided for connecting and sealing the inner and outer well head casings.

After the outer wall head casing has been assembled by bolting or otherwise fastening the casings together, the inner well head casing is lowered one section at a time to the sea floor. As each inner well head casing is put into its desired position, a casing hanger member, attached to the top of the inner well head casing is landed on a shoulder formed on the inner surface of the outer well head casing and latched thereto by resilient means, for example.

The casing hanger may then be cemented into its desired position by use of a so called land and cement casing hanger tool. One example of a tool for landing an assembly which incorporates the casing hanger with a seal is shown in U.S. Pat. No. 3,273,646, which issued Sept. 20, 1966, by R. W. Walker, entitled Circulating Casing Hanger Assembly.

Another approach to casing sealing is to use two separate running tools, one to land a casing hanger, and the second to land a separate casing hanger seal assembly upon the top of the casing hanger member. By rotation of the running tool attached to the seal assembly, the casing hanger seal assembly is locked into place against the inner surface of the outer well head casing and the outer surface of the inner well head casing. Provision is then made to pressure test the assembled seal.

If a faulting seal is found, it will be necessary to remove the casing hanger seal assembly. Before this invention, when this necessity arose, the running tool which was used to assemble the casing hanger seal assembly was used by rotation in an opposite direction from its installation rotation to disassemble the seal. In this situation, it was hoped that the seal assembly would break loose and free itself before the drill pipe connection between the casing hanger member and the inner well head casing, for example, would break loose. When the seal assembly was not the first to break loose from its connection with the inner surface of the outer well head casing, substantial problems were created retrieving the seal.

One of the earliest solutions to the problem of retrieving a loose tool within a well is discussed in U.S. Pat. No. 1,737,305, which issued Nov. 26, 1929, by C. T. Flemming, entitled Fishing Tool Attachment. This patent discloses a fishing tool which includes a planetary gear arranged for providing a reversible direction of rotation to allow unscrewing of tools or pipes, other than oil well tools or pipes. This tool relies on wedges to engage the inner surface of a well casing. Once engaged, the wedges cause a reverse rotational motion to be transmitted through planetary gears to a center piece which threadably engages the tool to be retrieved. This tool does not lend itself to the retrieval of seal assemblies, however.

Other planetary gear devices have been proposed for use in disconnecting well pipes which employ a planetary gear, including: U.S. Pat. No. 1,627,842, issued May 10, 1927 by C. R. Edwards; U.S. Pat. No. 3,322,006, issued May 30, 1967 by C. C. Brown; and U.S. Pat. No. 3,434,543, issued Mar. 25, 1969 by D. D. Webb. None of these devices are assigned to engage and retrieve a seal assembly. The releasing tool of the present invention was developed to assure proper engagement with a seal assembly and a timely release and retrieval thereof. Accordingly, an object of the present invention is to provide a seal assembly releasing tool which may be used to release the casing hanger seal assembly from engagement with the inner and outer surfaces of outer and inner well head casings.

BRIEF DESCRIPTION OF THE INVENTION

In accomplishing the foregoing object, there is provided a specially adapted tool which is attached to a running string that may be lowered into an outer well head casing to remove a faulting casing hanger seal assembly. The lower termination of the running string includes a support casing which has attached at its lower terminus a plurality of spring loaded cam followers which engage recessed cam surfaces located in the inner upper periphery of the casing hanger seal assembly. The cam recesses and cam followers act as detents which positively engage the seal assembly and prevent further rotation of the support case.

Further rotation of the running string is then translated through a planetary gear arrangement to an inner unlocking element which is rotatably mounted within the support case. With the support case restraint, the clockwise, for example, rotation of the running string causes a counterclockwise rotation of the unlocking element. Located at lower portions of the locking element is a second set of detents whose cam followers engage cam recesses located in a locking sleeve of the seal assembly. Continued rotation of the running string causes the second set of detents to rotate the locking sleeve thus lowering the toroidally shaped locking cam within the seal assembly and releasing locking wedges for freeing the seal assembly from the inner surface of the outer well head casing. The seal assembly may then be removed from the outer well head casing.

After the faulty seal assembly has been removed, the last installed inner well head casing and casing hanger member which remains may then be removed or a new seal may be inserted for testing.

DESCRIPTION OF THE DRAWINGS

A more complete understanding of the seal assembly releasing tool and of additional objects and advantages of the present invention will be obtained by reference to the following specification and drawings wherein.

BRIEF DESCRIPTION OF THE PREFERRED EMBODIMENT

Figure 1:
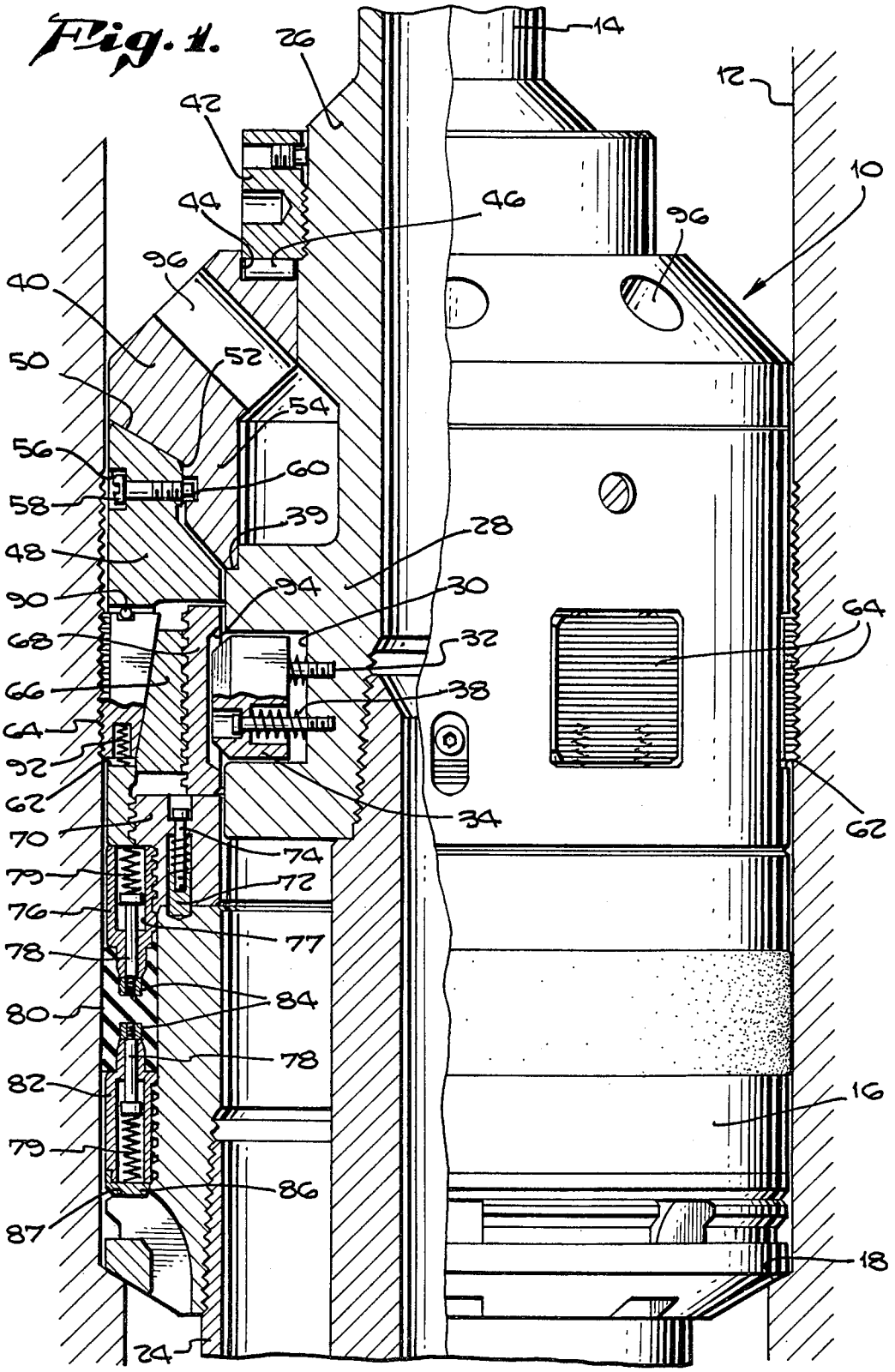
FIG. 1 is a side, partially sectioned view of a seal assembly and its insertion tool being installed in an outer well head casing.

Referring now to the drawings, FIG. 1 illustrates the seal assembly 10 for a casing hanger being installed within the inner diameter of an outer wellhead casing 12 by a running string 14. The running string 14 lowers the seal assembly until it lands upon a casing hanger 16. The casing hanger 16 was previously landed upon an upperly directed sloping support shoulder 18 formed within the inner diameter of the outer casing 12. The casing hanger 16 is retained against shoulder 18 by a resilient snaps 20 which are spring loaded by springs 22, FIG. 2. The casing hanger may then be cemented in place as described in U.S. Pat. No. 3,273,646 by R. W. Walker.

As the casing hanger 16 is landed and retained in its desired position, it carries with it an inner well head casing 24 which is also landed on a seal assembly 10 previously assembled in the next lowered section of the riser run. With the casing hanger 16 and inner wellhead casing 24 in place, it is then desired to insert the seal assembly 10 prior to lowering the next casing hanger. This is accomplished through the use of the running string 14 to which is attached a seal assembly running tool 26 which comprises a tubular continuation of the running string 14 having a toroidally shaped lower section 28. The lower section 28 is provided with opposite cam follower receiving chambers 30 the inner surfaces of which have been drilled and taped to receive mounting bolts 32. A cam follower 34 is inserted into the cam chamber 30 and retained therein by bolts 32 which also retain springs 38 that urge the cam follower 34 away from the inner surface of cam chamber 30. Cam followers 34 extends beyond the outer surface of the toroidally shaped section 28 to form a locking detent that will be described below. The upper surface of the lower section 28 is relieved to form a shoulder 39 that receives a locking collar 40 which is retained on the running tool 26 by a retaining collar 42 that fits into an annular groove 44 formed on the upper surface of collar 40. An annular sleeve bearing 46 is configured to fit within the annular groove 44 to rotatably support the tool 26 upon collar 40 when the tool is landed on seal 10.

The seal assembly 10 comprises a tubular member 48 whose upper edge 50 it tapers inwardly to receive and align the locking collar 40. The inner surface of member 48 is outwardly relieved to form an annular chamber 52 which receives a reduced male section 54 formed on the lower portion of collar 40. Just below the upper edge 50 of the tubular member 48 are bored a plurality of apertures 56 into which are inserted shear bolts 58. The shear bolts 58 engage apertures 60 within the outer surface of section 54. The shear bolts retain the seal assembly 10 upon the running tool 26 until such time as it is desired to remove the running tool.

The tubular member 48 includes a plurality of ports 62 which receive wedge members 64. The wedge members 64 are actuated by a toroidally shaped tapered collar 66 which is raised and lowered by a locking sleeve 68 that engages the tapered collar 66 through screw threads, such as acme threads.

The locking sleeve 68 is retained within the lower inner diameter of the tubular member 48 by a detent collar 70 which is attached to member 48 by screw threads. Extending from the lower surface of detent collars 70 are a plurality of spring loaded detents 72 mounted upon a thread stud 74. Attached to the outer surface of the detent collars 70 is a seal mounting sleeve 76 whose upper surface is counterbored at 77 to receive a plurality of bolts 78 urged in a downward direction by springs 79. The lower surface of the sleeve 76 is relieved to allow its inner and outer diameter to form an annular sleeve which receives a seal 80. A similarly configured lower seal sleeve 82 is provided with a similar set of counterbores and bolts 78 urged in an upward direction by springs 79.

It will be seen that the seal 80 has an H-shaped cross section with threaded inserts 84 which receive the spring loaded bolts 78. In this manner, the seal is retained to the upper seal sleeve 76 and retains the lower seal sleeve 82. A cap 86 is attached to the lower surface of the lower seal sleeve 82 which lands upon a shoulder 87 formed in hanger 16 to complete this portion of the assembly. The inner surface of the lower seal sleeve 82 is thread free and abuts against external threads on the casing hanger 16 which act as a labyrinth seal.

Figure 3:
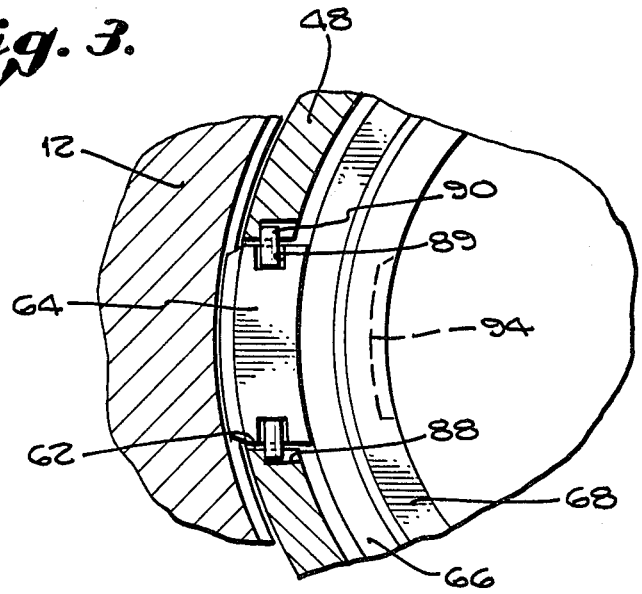
FIG. 3 is a sectional view taken along line III—III of FIG. 2.

The details of the wedge members 64 may be more fully explained with reference to FIG. 3 where it will be seen that port 62 is provided with a pair of shoulders 88 along its inner upper surfaces. The upper edges of the wedge 64 are also slotted at 89 to receive a pair of rolling pins 90. The lower surface of the wedge 64 is provided with a pair of apertures into which are inserted springs 92, FIG. 1. As seen best in FIG. 3, the inner surface of the locking sleeve 68 is provided with a plurality of cam surfaces or detents 94 which receive the cam followers 34.

As the running tool 26 is lowered through the inner diameter of the outer well head casing 12, the seal assembly 10 is landed on and brought into engagement with the casing hanger 16. The running tool 26 is then rotated to cause the rotation of the seal assembly 10 and the engagement of detents 72 into apertures in the upper surface of casing hanger 16. As the detents 72 engage, continued turning causes the cam followers 34, engaged within cam surfaces 94, to exert enough torque upon the locking sleeve 68 to cause its rotation, thus raising the tapered collar 66. As the tapered collar 66 raises, it causes the wedges 64 to extend outwardly upon rollers formed by pins 90. It will be seen that the outer surface of the wedges is threaded with a fine pitch thread which matches a similar thread on the inner surface of casing 12. Continued rotation of tool 26 causes the tapered collar 66 to rise further and fully extend the wedge members 64 which threadably engage the inner threads on well head casing 12 causing the tubular member 48 to move in a downward direction for urging the upper seal sleeve 76 against the seal 80 thus expanding it and sealing the seal assembly 10 between the inner diameter of the outer casing 12 and the outer diameter of casing hanger 16.

The lower section of the running tool 26 which fits within the inner diameter of the inner well head casing 24 previously lowered with the casing hanger 16 is provided with a seal, not shown. It is now possible to pressurize the outer casing 12. That pressure passes through ports 96 and down into the inner diameter of casing 24. In this manner, the seal assembly 10 can be pressure tested before it is finally locked into place. If the test is not satisfactory, the seal assembly may be immediately retrieve by reversing the rotational movement of the running tool.

Figure 2:
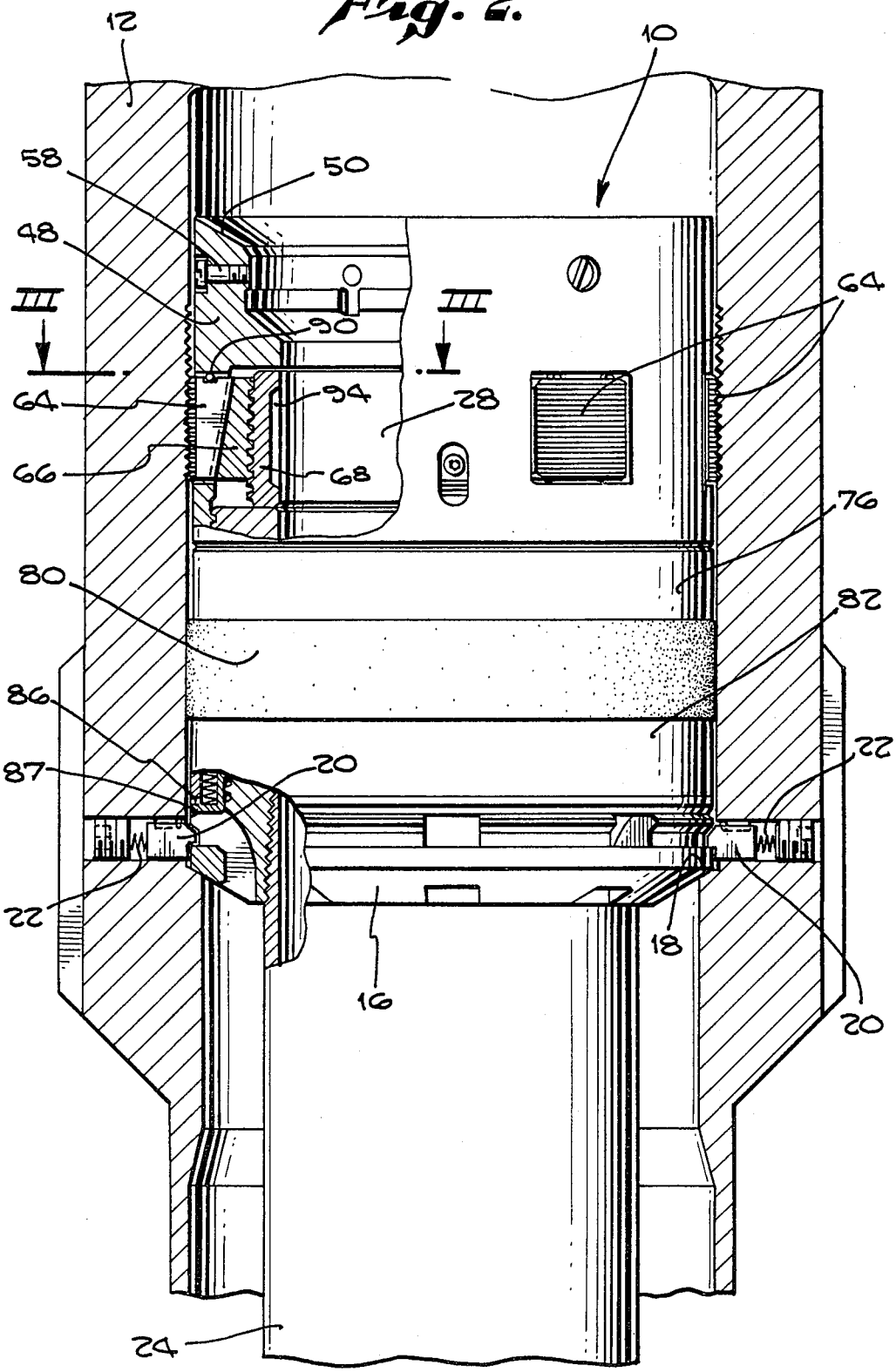
FIG. 2 is a side, partially sectioned view showing the seal assembly installed.

If the seal is satisfactory, the tool 26 is removed by pulling the tool in a vertical direction which shears the shear bolts 58, FIG. 2, for freeing the locking collar 40 from the tubular seal assembly member 48. In the prior art, if the seal was not satisfactory or if it became necessary to remove the seal assembly 10 after the running tool 26 had been removed, the running tool was reinserted. By rotating the tool to the left it was hoped that the seal assembly would break loose before the drill pipe connection. As this method was not satisfactory in many situations, the seal assembly releasing tool of the present invention was developed.

Figure 4:
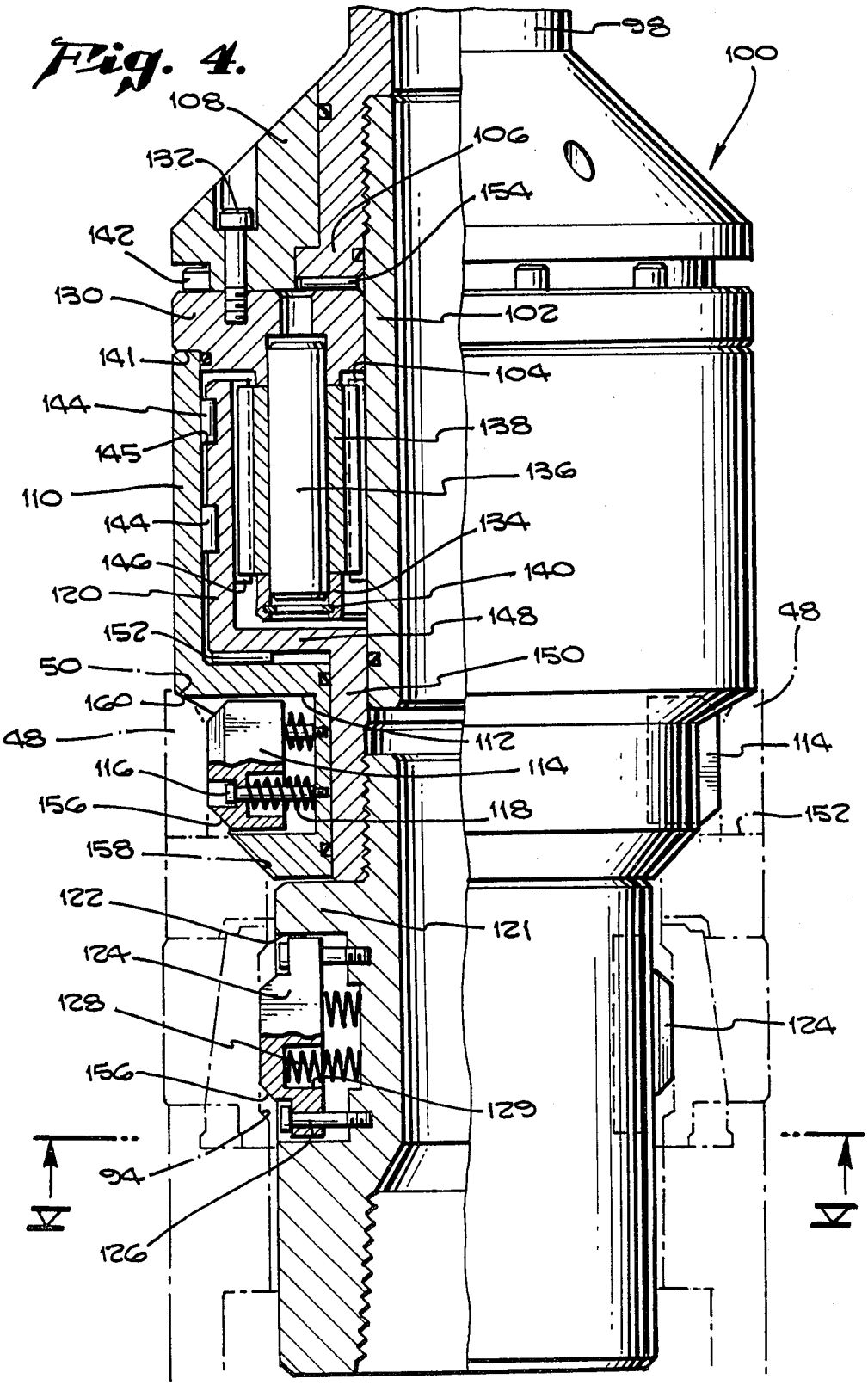
FIG. 4 is a side, partially sectioned view showing the seal assembly releasing tool of the present invention.

As seen in FIG. 4, a running string 98 is extended through the inner diameter of the outer well head casing 12 with a seal assembly releasing tool 100 attached to its lowermost end. The inner diameter of the lowermost end of running string 98 is outwardly relieved and threaded to receive a sleeve 102 which outer surface mounts a gear 104. The outer surface of the lower most end of running string 98 includes an outwardly extending annular shoulder 106 which mounts a seal assembly retaining collar 108. The retaining collar 108 forms part of a support case 110 whose lower surface is inwardly relieved to fit within the tapered edge 50 of tubular member 48.

The relieved surface of the support case 110 which extends below the member 48 includes cam follower chambers 112 which receive cam followers 114 similar to cam followers 34 which are retained within the recess 112 by bolts 116 and springs 118. Mounted within the support case 110 is an unlocking element 120 which extends beyond the lower portion of the support case 110 and includes a lower tubular member 121 having cam follower chambers 122 which mount cam followers 124. Unlike the cam followers 114, the cam followers 124 are mounted on bolts 126 which provide a sliding surface for the follower that is urged in an outward direction by springs 128 which fit into recesses 129 between the bolts 126 rather than about the bolts as do springs 118.

The remaining portion of the support case 110 includes an annular collar 130 attached to the lower surface of collar 108 by bolts 132. Extending from the lower surface of the collar 130 is an annular sleeve 134 which has been centrally bored to receive a shaft 136. The side walls of the sleeve 134 are milled to receive a gear 138 having a center bore through which the shaft 136 may pass which is retained within the bore by a clipring 140.

The support case 110 fits within a relief 141 on the lower surface of collar 130 and is retained therein by bolts 142. The inner surface of the support case 110 receives the unlocking element 120 which has a pair of sleeve bearings 144 mounted in grooves 145 in the outer surface for sliding engagement with the inner surface of support case 110. The inner surface of the unlocking element 120 mounts a gear 146 which interacts with gears 138 and 104. The lower portion of the unlocking element 120 includes a horizontal shoulder 148 and sleeve 150 which fits within the inner diameter of the lower section of support case 110. An annular bearing 152 mounts between the shoulder 148 of unlocking element 120 and the support case 110 to provide rotational support for the unlocking element 120. Similarly, a second annular bearing 154 mounts between the lower surface of shoulder 106 and the upper surface of collar 130 to permit the support case 110 to rotate on the shoulder 106 of running string 98.

It will be seen that the completed seal assembly releasing tool 100 shown in FIG. 4 may be lowered into an outer well head casing 12 and landed upon the seal assembly 10. As the seal assembly releasing tool 100 is inserted into the seal assembly 10, tapered surfaces 156 on both cam followers 114 and 124 engage similar tapered surfaces 50 and 158 on the tubular member 48 and yield inwardly against the urging of springs 118 and 128, respectively. The lower most outer edge of the support case 110 is tapered at 160 to engage the tapered inner surface of the member 48. As these two surfaces meet, the total 100 is firmly landed upon the seal assembly 10.

Figure 5:
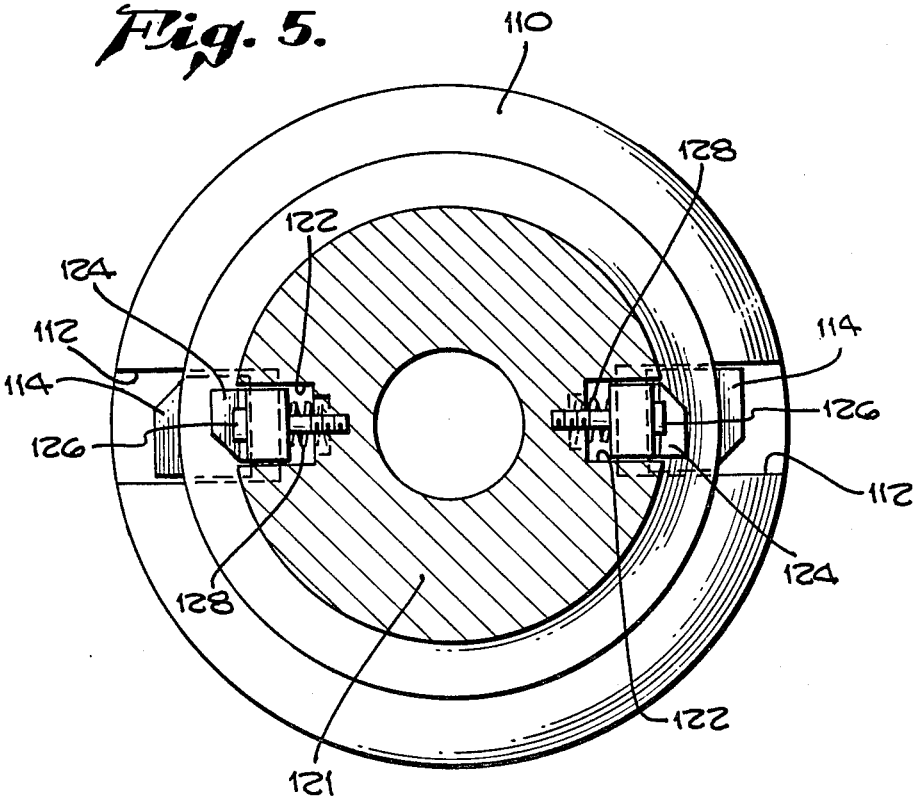
FIG. 5 is a sectional view taken along line V—V of FIG. 4.

Rotation in a clockwise direction, for example, when viewed from above, of riser string 98 will cause the support case 110 and, perhaps, the unlocking element 120 to rotate in the clockwise direction. As each cam follower 114 engages a key way 156 in the outer diameter of member 48, it extends into that recess under the urging of springs 118 and is latched therein. With the cam 114 latched, the rotational motion of support case 110 ceases. Further clockwise rotation, counterclockwise in the bottom view of FIG. 5, of the string 98 causes continuing rotation of the sleeve 102 and gear 104. With the outer surface of support case 110 now locked firmly in place, the string 98 and sleeve 102 will now begin to rotate free of support case 110 including collars 108 and 130. Gear 104 will thus cause the rotation of gear 138 about shaft 136, which, in turn, will rotatably drive gear 146 for rotating the unlocking element 120 in a counterclockwise direction, clockwise in FIG. 5. As the unlocking element turns, the cam follower 124 will engage the recess 94 located within the locking sleeve 68.

Once the cam follower 124 has engaged the cam surface 94 formed by this recess, the cam will transmit counterclockwise rotation to the locking sleeve 68 for unscrewing and lowering the tapered collar 66 and freeing wedge members 64. Further rotation will free the seal assembly 10 from the well head casing 12 and permit the removal of the seal assembly 10 and its releasing tool 100. It will be seen that this operation permits the removal of the seal assembly 10 without breaking the threaded drill pipe connections. Once the seal assembly is free, it can be raised by retrieving the string 98.

The seal assembly releasing tool has been described as having cam followers mounted upon inner and outer concentric members which may be rotated in opposite directions by a planetary gear system. Clearly, the specific arrangement of the cam followers may be varied provided the cams are arranged on two oppositely rotating sleeves, one having a larger outer diameter than the other for engagement with two apertures one having a larger inner diameter than the other. While the cam surfaces may be varied, it will be understood that other modifications and variations are possible within the framework of the invention as claimed. Accordingly, the invention should be limited only the by the following claims.

I claim:

1. In a well formed with an outer well head casing and a concentric inner well head casing mounted upon a hanger which lands upon a shoulder formed on the inner surface of said outer well head casing having a casing hanger seal assembly mounted between said hanger and said outer casing an improved seal assembly releasing tool comprising: a shaft for lowering said tool into said outer casing of said well; an outer support case rotatably mounted upon said shaft; an inner unlocking element rotatably mounted within said outer support case; a planetary gear mounted between said outer case and said inner element; said outer support case having a first cylindrical surface area which slidably fits within a first cylindrical opening of said seal assembly, the surface of which is relieved to form first cam surfaces therein; first cam follower means extending from said first surface area of said outer support case for engaging said first cam surfaces in said first cylindrical opening surface; said inner unlocking element having a second cylindrical surface area which slidably fits within a second concentric cylindrical opening of said seal assembly the surface of which is relieved to form second cam surfaces therein; and second cam follower means extending from said second surface area of said inner unlocking element for engaging said second cam surfaces on said second cylindrical opening surface; wherein rotation of said tool turns and locks said first cam followers into said first cam surfaces and continued rotation turns and locks said second cam followers into said second cam surfaces in an opposite direction for releasing said seal assembly.

2. In a well formed with an outer well head casing and a concentric inner well head casing mounted upon a hanger which lands upon a shoulder formed on the inner surface of said outer well head casing having a casing hanger seal assembly mounted between said hanger and said outer casing an improved seal assembly releasing tool comprising: a shaft for lowering said tool into said outer casing of said well; and outer support case rotatably mounted upon said shaft; an inner unlocking element rotatably mounted within said outer support case; a planetary gear mounted between said outer case and said inner element; said outer support case having a first cylindrical surface area which slidably fits within a first cylindrical opening of said seal assembly, the surface of which is relieved to form first cam surfaces therein; first spring biased cam followers extending from said first surface area of said outer support case for snapping into said first cam surfaces in said first cylindrical opening surface; said inner unlocking element having a second cylindrical surface area which slidably fits within a second concentric cylindrical opening of said seal assembly, the surface of which is relieved to form second cam surfaces therein; and second spring biased cam followers extending from said second surface area of said inner unlocking element for snapping into said second cam surfaces on said second cylindrical opening surface; wherein rotation of said tool turns and snaps said first cam followers into said first cam surfaces and continued rotation turns in an opposite direction and snaps said second cam followers into said second cam surfaces for releasing said seal assembly.

3. A seal assembly releasing tool for use in wells having a seal mounted between an inner and an outer well casing comprising: said seal having a tubular shape with an upper, inner surface forming a first cylindrical opening and a second, lower, inner surface forming a second cylindrical opening of said seal; cam surfaces in said first and second cylindrical openings; said tool having an outer support case and an inner unlocking element rotatably mounted upon a turning shaft and joined by planetary gear means; said outer support case having a lower portion extending down into said first cylindrical opening; first cam followers extending from said lower portion of said case for engaging cam surfaces in said first cylindrical opening; said inner unlocking element having a lower portion extending below said lower portion of said outer support case and into said second cylindrical opening of said seal; second cam followers extending from said lower portion of element for engaging said cam surfaces in said second cylindrical opening; wherein rotation of said tool shaft turns and locks said first cam followers into cam surfaces in said first cylindrical opening, continued turning turns said second cam followers in an opposite direction and locks said second cams into cam surfaces in said second cylindrical opening to release said seal.

4. A seal assembly releasing tool for use in wells having a seal mounted between an inner and an outer well casing comprising: said seal having a tubular shape with an upper, inner surface forming a first concentric cylindrical opening and a second, lower, inner surface forming a second cylindrical opening of said seal; means providing cam surfaces in said first and second concentric cylindrical openings; said tool having an outer support case and an inner unlocking element rotatably mounted upon a turning shaft and joined by planetary gear means; said outer support case having a lower portion extending down into said first cylindrical opening; first spring loaded latching cam followers extending from said lower portion of said case for latching cam surfaces in said first cylindrical opening; said inner unlocking element having a lower portion concentrically extending below said lower portion of said outer support case and into said second cylindrical opening of said seal; second spring loaded latching cam followers extending from said lower portion of said element for latching cam surfaces in said second cylindrical opening; wherein rotation of said tool shaft turns and latches said first cam followers into cam surfaces in said first cylindrical opening, continued turning turns said second cam followers in an opposite direction and latches said second cams into cam surfaces in said second cylindrical opening to cause the release of said seal.

5. A well seal assembly releasing tool for releasing a seal assembly having means for providing first and second cam surfaces relative to which portions of the releasing tool may be aligned, said tool comprising;

an outer case rotatably mounted on a shaft; an inner element rotatably mounted within the case and planetary gear train means for coupling said element and case;

first cam follower means on said case for engaging first cam surfaces on said seal and second cam follower means on said element for engaging second cam surfaces on said seal wherein:

rotation of said shaft turns said first cam follower means into engagement with said first cam surfaces and continued rotation turns said second cam follower means in an opposite direction into engagement with said second cam surfaces to facilitate release of said seal assembly.

6. A well seal assembly releasing tool for releasing a seal assembly having means for providing first and second cam surfaces relative to which portions of the releasing tool may be aligned, said tool comprising:

first cam follower means on said tool for engaging first cam surfaces on said seal;

second cam follower means on said tool for engaging second cam surfaces on said seal; and means for mounting said first and second cam follower means on said tool whereby rotation of said tool turns said first cam follower means into engagement with said first cam surfaces and continued rotation turns said second cam follower means in an opposite direction into engagement with said second cam surfaces to facilitate release of said seal assembly.

* * * * *